United States Patent [19]

Mochizuki

[11] Patent Number: 4,959,657

[45] Date of Patent: Sep. 25, 1990

[54] OMNIDIRECTIONAL ANTENNA ASSEMBLY

[75] Inventor: Akio Mochizuki, Tokyo, Japan

[73] Assignee: NEC Corporation, Japan

[21] Appl. No.: 320,467

[22] Filed: Mar. 8, 1989

Related U.S. Application Data

[63] Continuation of Ser. No. 70,259, Jul. 6, 1987, abandoned.

[30] Foreign Application Priority Data

Jul. 4, 1986 [JP] Japan ..... 61-157421

[51] Int. Cl.[5] ..... H01Q 21/29

[52] U.S. Cl. ..... 343/725; 343/773; 343/837; 343/846

[58] Field of Search ..... 343/797, 774, 846, 773, 343/775, 725, 836, 837, 829, 853, 893

[56] References Cited

U.S. PATENT DOCUMENTS 2,532,551 12/1950 Jarvis ..... 343/774
3,919,710 11/1975 Fletcher et al. ..... 343/846

OTHER PUBLICATIONS

Ohmaru et al., "A Switching Antenna for Spin Stabilized Satellites", NHK Tech. Journal (Japan), vol. 22, No. 4, 1970.

*Primary Examiner*—Michael C. Wimer
*Attorney, Agent, or Firm*—Ostrolenk, Faber, Gerb & Soffen

[57] ABSTRACT

An omnidirectional antenna assembly for use with a satellite and others includes a four-element whip antenna, a first and a second reflector which are positioned to face each other, and a third reflector connecting the first and second reflectors to each other. The third reflector is provided with a frustoconical configuration and is highly conductive, whereby the range of antenna gain is broadened.

6 Claims, 4 Drawing Sheets

OMNIDIRECTIONAL ANTENNA ASSEMBLY this is a continuation of application Ser No. 07/070,259, filed Jul. 6, 1987, abandoned.

BACKGROUND OF THE INVENTION

The present invention relates to an omnidirectional antenna assembly having a wide range of antenna gain and are particularly applicable to satellites, etc. More particularly, the present invention is concerned with an omnidirectional antenna assembly whose gain range is increased by combining a reflector of a four-element whip antenna with another reflector (e.g., a reflector constituting part of a satellite body or a reflector of a biconical antenna or like antenna) which serves as a second antenna in relation to the four-element whip.

A four-element whip antenna is an omnidirectional antenna which is extensively used with satellites, etc. The four-element whip antenna has a reflector which is spaced from and electrically connected to another reflector by a feeder cable. A problem with these antennas is that the primary radiation from one of the reflectors and the secondary reflection (reflected wave) from the other reflector interface with each other, with the result that at angles $\theta$ of radiation pattern adjacent $\pm 90°$, great ripples are developed and the level of radiation is sharply lowered to reduce the range of availabe gain. Biconical antennas, the combination of a four-element whip antenna and a biconical antenna, and the like are also useful as omnidirectional antennas, but they have the same problem as the four-element whip antenna.

SUMMARY OF THE INVENTION

It is therefore an object of the present invention to provide an omnidirectional antenna assembly which is free from the interference of the primary and secondary radiations as caused by the independent relectors and, therefore, attains a wider range of antenna gain.

It is another object of the present invention to provide a generally improved omnidirectional antenna assembly.

An omnidirectional antenna assembly of the present invention comprises an omnidirectional antenna assembly comprising a four-element whip antenna. The four-element whip antenna includes a first reflector having an outer perimeter which is disk shaped. Four whip elements are mounted on the first reflector in such a manner that the four whipped elements are located on a first side of the first reflector where the whip elements receive electromagnetic waves reflected by the first reflector. A second reflector is included, as well as a frustroconical reflector having a frustroconical shape. The frustroconical reflector is for interconnecting the first and second reflectors such that the frustroconical reflector is located on a second side of the first reflector and is coupled to and flares away from the outer perimeter of the first reflector and such that the second reflector is connected to an end of the frustroconical reflector that is opposite to the first reflector. The orientation of the first reflector, the frustroconical reflector, the second reflector and the four whip elements are such that electromagnetic waves radiated from the four whip elements reach behind the four-element whip antenna.

The above and other objects, features and advantages of the present invention will become more apparent from the following description taken with the accompanying drawings.

DESCRIPTION OF THE PREFERRED EMBODIMENTS

To better understand the present invention, a brief reference will be made to prior art antenna asemblies.

Figure 1:
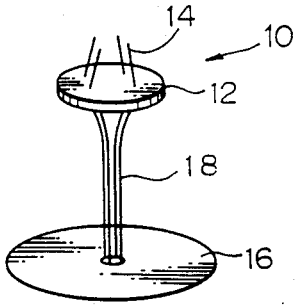
Fig. 1 PRIOR ART
FIG. 1 is a perspective view of a prior art four-element whip antenna with a reflector.

Referring to FIG. 1, a prior art four-element whip antenna is shown and generally designated by the reference numeral 10. As shown, the four-element whip antenna 10 includes a reflector 12 on which whip elements, 14 are mounted. Another reflector 16, which constitutes part of a satellite body, faces the reflector 12 and is spaced therefrom. The reflectors 12 and 16 are electrically connected to each other by a feeder cable 18.

Figure 2:
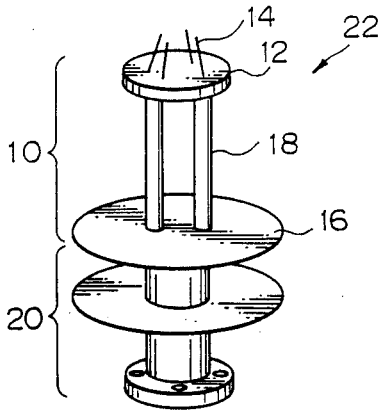
Fig. 2 PRIOR ART
FIG. 2 is an external view of a prior art antenna assembly made up of a four-element whip antenna and a biconical antenna.

FIG. 2 shows an antenna which is implemented with the combination of the four-element whip antenna 10 of FIG. 1 and a biconical antenna 20. In the arrangement of FIG. 2, the reflector 16 of the biconical antenna 20 also serves as a reflector forming part of the four-element whip antenna 10.

Figure 3:
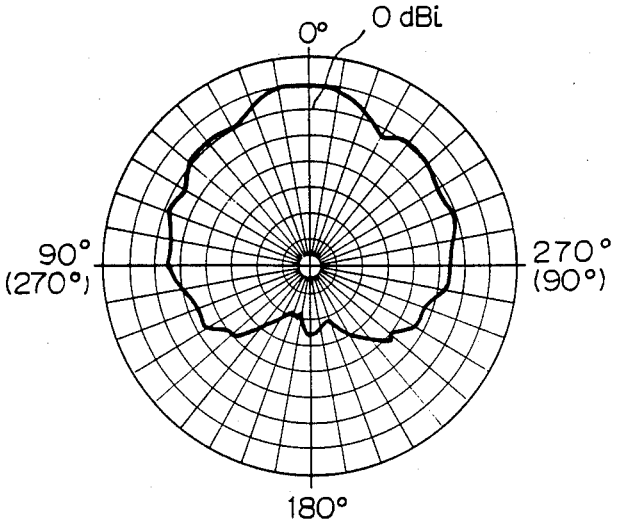
Fig. 3 PRIOR ART
FIG. 3 shows a chart representative of a radiation pattern particular to any of the antennas of FIGS. 1 and 2.

FIG. 3 shows a radiation pattern particular to each of the prior art antennas as shown in FIGS. 1 and 2. As shown in FIG. 3, at angles $\theta$which are adjacent $\pm 90°$ and greater, great ripples and sharp falls of the signal level occur due to the inteference of the primary reflection from the reflector 12 and the secondary reflection (reflected wave) from the reflector 16, critically limiting the range of practical use of the antennas.

Figure 4:
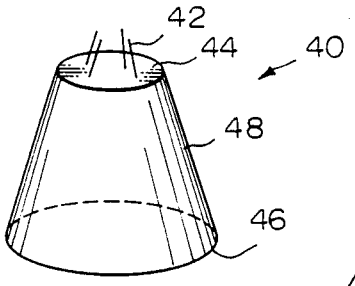
FIG. 4 is a perspective view showing an omnidirectional antenna in accordance with the present invention.
Figure 5:
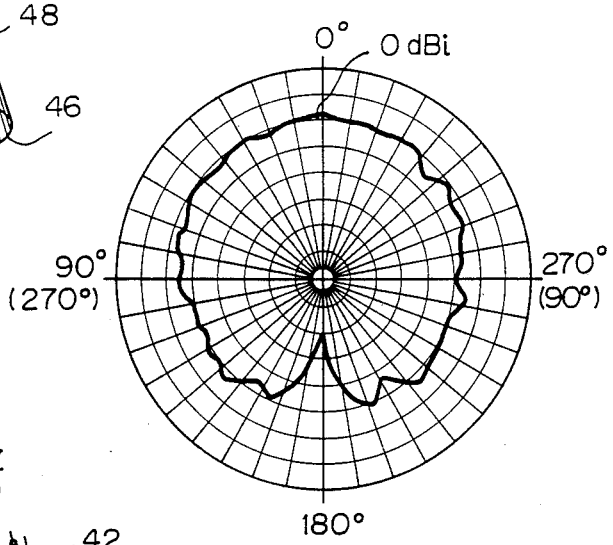
FIG. 5 is a chart representative of a radiation pattern particular to the antenna of FIG. 4.

Referring to FIG. 4, an omnidirectional antenna assembly embodying the present invention is shown. This antenna assembly, generally 40, is made up of four whip elements 42, a first reflector 44, and a second reflector 46 which is mounted on a satellite body, not shown. The first and second reflectors 44 and 46 are connected to each other by a frustoconical reflector 48. In this configuration, the reflectors 44 and 46 and the frustoconical reflector 48 apparently consitute a single solid reflecting body. It will be seen from the radiation pattern of FIG. 5 that such a reflecting body allows waves to be propagated even to the back of the reflectors due to radio frequency (RF) current, which flows through the frustoconical section. Specifically, the radiation pattern of FIG. 5 shows that a gain lower than peak gain by 5 dBi is maintained over the angle $\theta$ of approximately $\pm 140°$, i.e., radiation occurs over a far broader angular range than in the prior art antennas.

Figure 6:
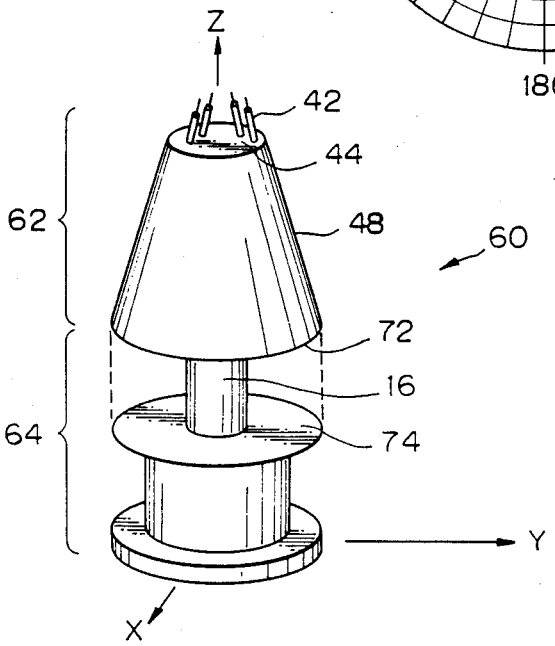
FIG. 6 is a perspective view showing another embodiment of the present invention.
Figure 7:
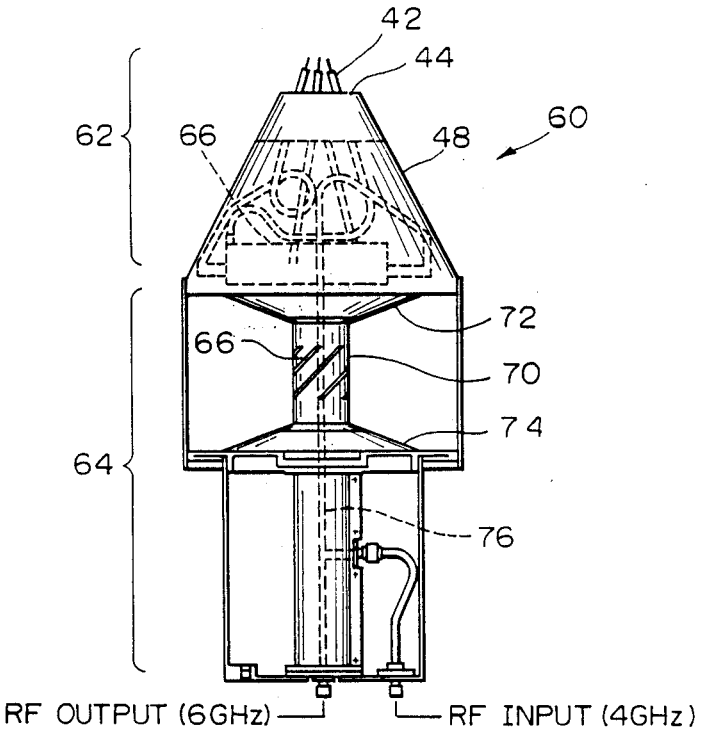
FIG. 7 is a sectional side elevation of the antenna assembly of FIG. 6.

Referring to FIGS. 6 and 7, another embodiment of the present invention is shown. An omnidirectional antenna asembly 60 of this particular embodiment is constituted by the combination of a four-element whip antenna 62 for telecommand/ranging reception and another type of antenna, e.g., a biconical antenna 64 for telemetry/ranging transmission, so that among various applications the application to a satellite may be facilitated. In a prior art combination of a four-element whip antenna and a biconical antenna, e.g., the combination type antenna 22 of FIG. 2, the reflection pattern of the four-element whip antenna is prevented from reaching the back of the reflector due to the influence of the reflector 16, as shown in FIG. 3. In contrast, in the antenna assembly 60 in which the reflectors 44 and 72 are connected to each other by the frustoconical reflector 48, the reflection pattern covers even the back, as shown in FIG. 8.

In detail, as shown in FIGS. 6 and 7, the four-element whip antenna 62 is mounted on the top of the biconical antenna 64 and is provided with the four whip elements 42, reflector 44, and frustoconical reflector 48. The whip elements 42 are connected to a hybrid type combiner 66 (FIG. 7) which is accommodated in a space that is defined by the frustoconical reflector 48. When the four-element whip antenna 62 receives circularly polarized waves, induced signals on each elements 42 of the antenna 62 are equal in amplitude, but different in quarte phase between adjacent elements 42. These four induced signals are combined by the hybrid combiner 66 to become one signal and fed to a transponder, not shown. The antenna radiation pattern is axially symmetrical carbioid from +Z axis which is the center axis of the assembly 60, as shown in FIG. 6.

The biconical antenna 64 comprises a number of inclined slots 66 (slant angle of approximately 45°) equally spaced about the circumference of an outer conductor 70 of coaxial line, and two circular plate reflectors 72 and 74. A double coaxial line 76 is disposed in a central part of the antenna 64 for inputting and outputting RF signals. The antenna 64 radiates left-hand circular polarized (LHCP) wave in the perpendicular plane to the Z axis. It has the peak gain on the direction perpendicular to the Z axis and generates an axially symmetrical troidal RF pattern.

Figure 8:
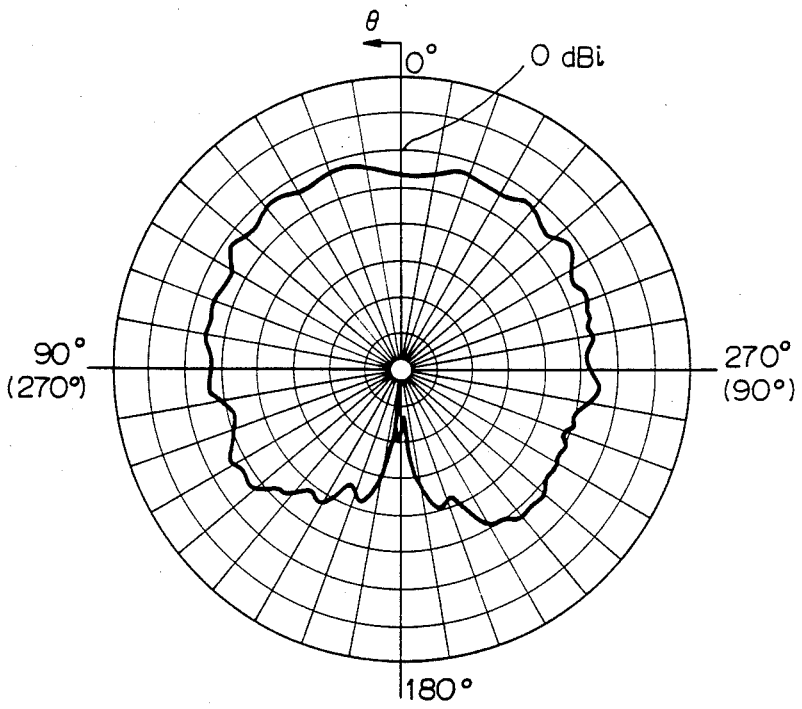
FIG. 8 is a chart representative of a gain pattern particular to the antenna assembly of FIGS. 6 and 7.

The antenna gain pattern shown in FIG. 8 was produced under the conditions of a frequency of 6.17 GHz, a receive (Rx) polarization of RHCP (right-hand circular polarized) wave, and a measured plane of $\phi=0°$. In FIG. 6, assume a coordinates system of the antenna assembly 60. Then, the plane of $\phi=0°$ is the X-Z plane.

In summary, it will be seen that the present invention provides an omnidirectional antenna assembly in which two reflectors are interconnected by a frustoconical reflector to allow a reflection pattern to reach even the back of the reflectors, broadening the range of antenna gain.

Various modifications will become possible for those skilled in the art after receiving the teachings of the present disclosure without departing from the scope thereof.

What is claimed is:

1. An omnidirectional antenna assembly comprising a four-element whip antenna, said four-element whip antenna including:

a first reflector having an outer perimeter which is disk shaped;

four whip elements mounted on said first reflector in such a manner that said four whip elements are located on a first side of said first reflector where said whip elements receive electromagnetic waves reflected by said first reflector;

a second reflector; and a frustroconical reflector having a frustroconical shape for interconnecting said first reflector and said second reflector such that said frustroconical reflector is located on a second side of said first reflector and is coupled to and flares away from said outer perimeter of said first reflector and such that said second reflector is connected to an end of said frustroconical reflector that is opposite to said first reflector;

the orientation of said first reflector, said frustroconical reflector, said second reflector and said four whip elements being such that electromagnetic waves radiated from said four whip elements reach behind said four-element whip antenna.

2. The omnidirectional antenna assembly of claim 1, wherein said second reflector is made of a material which is electrically conductive.

3. The omnidirectional antenna of claim 1, wherein said second reflector constitutes part of a body of an apparatus on which said antenna assembly is supported.

4. The omnidirectional antenna of claim 1, wherein said second reflector forms part of a further antenna.

5. The omnidirectional antenna assembly of claim 4, wherein said further antenna comprises a biconical antenna.

6. The omnidirectional antenna of claim 1, wherein said second reflector is disk shaped.

* * * * *